US009169656B2

(12) United States Patent
Thornton

(10) Patent No.: US 9,169,656 B2
(45) Date of Patent: Oct. 27, 2015

(54) BASE UNIT AND FLOORING SYSTEM

(75) Inventor: William Thornton, Atlanta, GA (US)

(73) Assignee: Tarkett GDL, Lentzweiler (LU)

( * ) Notice: Subject to any disclaimer, the term of this patent is extended or adjusted under 35 U.S.C. 154(b) by 0 days.

(21) Appl. No.: 14/233,340

(22) PCT Filed: Jul. 19, 2011

(86) PCT No.: PCT/EP2011/062303

§ 371 (c)(1),
(2), (4) Date: Sep. 29, 2014

(87) PCT Pub. No.: WO2013/010581

PCT Pub. Date: Jan. 24, 2013

(65) Prior Publication Data

US 2015/0020469 A1 Jan. 22, 2015

(51) Int. Cl.

| | |
|---|---|
| ***E04F 15/22*** | (2006.01) |
| ***E04F 15/02*** | (2006.01) |
| ***E04F 15/024*** | (2006.01) |

(52) U.S. Cl.

CPC ..... *E04F 15/02177* (2013.01); *E04F 15/02038* (2013.01); *E04F 15/02044* (2013.01); *E04F 15/02447* (2013.01); *E04F 15/225* (2013.01); *E04F 2015/0205* (2013.01)

(58) Field of Classification Search

CPC ..... E04F 15/02005; E04F 15/02016; E04F 2015/0205; E04F 2015/02055; E04F 15/02072; E04F 15/02447; E04F 15/02458; E04F 15/04; E04F 15/225

USPC ..... 52/385, 403.1

See application file for complete search history.

(56) References Cited

U.S. PATENT DOCUMENTS

| | | | | |
|---|---|---|---|---|
| 1,047,966 | A * | 12/1912 | McCarthy | 52/480 |
| 1,787,067 | A * | 12/1930 | Eisler | 52/364 |
| 3,562,990 | A | 12/1968 | Boettcher | |
| 6,363,675 | B1 | 4/2002 | Shelton | |
| 2003/0188921 | A1 * | 10/2003 | Kakimoto et al. | 181/285 |

FOREIGN PATENT DOCUMENTS

| | | |
|---|---|---|
| DE | 2108652 A1 | 2/1971 |
| DE | 3545969 A1 | 9/1986 |
| DE | 9201939 U1 | 2/1992 |
| EP | 0916779 A1 | 5/1999 |

* cited by examiner

*Primary Examiner* — Patrick Maestri

(74) *Attorney, Agent, or Firm* — Reinhart Boerner Van Deuren P.C.

(57) ABSTRACT

The present invention relates to a flooring system base unit (1), made of a resilient material, and comprising a first portion (3) having a first surface (4) which, in use, contacts the floor to cover, and a second surface (5), opposite to said first surface (4), a second portion (7) set above said first portion (3), at least one space (9) provided on said second surface (5) of said first portion (3) and provided by a side edge of said second portion (7), anchoring means provided through said first and second portions (3, 7) to anchor said base unit (1) to the floor to cover.

19 Claims, 7 Drawing Sheets

BASE UNIT AND FLOORING SYSTEM

FIELD OF THE INVENTION

The present invention relates to a base unit, or sleeper, for flooring system and to a flooring system, particularly to an indoor sports flooring system, comprising such a base unit.

PRIOR ART AND RELATED TECHNICAL BACKGROUND

It is well known that sport grounds are generally covered by synthetic material or by a wood inlaid flooring to provide a surface with suitable properties for players and sportsmen.

U.S. Pat. No. 3,562,990 discloses a flooring construction comprising a flooring laid over sleeper sections, the sleepers being secured on the concrete by means of metallic retainers and nails. However such a flooring system presents the drawback of having poor rebounding or shock-absorbing properties.

Resiliency is typically obtained by implementing a shock absorption device under a base flooring. For example U.S. Pat. No. 5,303,526 discloses a portable hardwood floor system of interconnected floor sections mounted on a resilient pad comprising a glide member located below the pad. The floor system has thus a dimensional stability and resiliency. Furthermore, the glide member is slidable to enhance maneuverability in positioning and aligning the floor sections to facilitate interconnectable floor sections. The glide member also protects the portable floor section during frequent handling.

Regarding anchored flooring, U.S. Pat. No. 6,363,675 discloses a structure having vertical restraints secured to a base in parallel relationship to each other and the restraints have outwardly directed flanges, parallel spaced apart struts positioned under the flanges and transverse to the vertical restraints, a resilient upward biasing means secured under the struts so that the struts are resiliently engaged with the outward directed flanges of two adjacent vertical restraints, parallel spaced apart nailers secured transversely to the top surface of the struts and parallel to the vertical restraints, and a wood flooring secured transversely to the nailers. The spaced apart relationships or the struts and nailers provide a ventilated subfloor. The spaced apart relationships of the vertical restraints, struts and nailers permits the "tuning" of the subfloor by modifying the size and spacing of the subfloor components to effect changes in the measurable properties of the floor.

AIMS OF THE INVENTION

The present invention aims to provide a flooring system that do not have the drawbacks of the prior art.

The invention aims to provide a flooring system having a good shock absorption and good load resistance.

The invention aims to provide a flooring system being simple to install.

SUMMARY OF THE INVENTION

The present invention relates to a flooring system base unit made of a resilient material and comprising a first portion having a first surface which, in use, contacts the floor to cover, and a second surface, opposite to the first surface, a second portion set above the first portion, at least one space provided on the second surface of the first portion and provided by a side edge of said second portion, anchoring means provided through the first and second portions to anchor the base unit to the floor to cover.

According to particular embodiments, the base unit may comprise one, or a combination, of any of the following characteristics:

- the base unit comprises two spaces running along both sides of the second portion,
- the second portion is provided along the entire length of the first portion,
- the anchoring means comprising at least one hole extending from the upper surface of the second portion to the first surface of the first portion, through the entire height of the base unit,
- the base unit comprises fastening means provided on the at least one space to fasten a base platform,
- the base unit further comprising a channel having "U" shape and extending outwardly and perpendicularly from the edge of the second portion of the base unit,
- the first portion (3) has a truncated cone cross section and the second portion (7) has a rectangular cross section.

The present invention relates also to a flooring system section piece comprising at least a first and a second base unit according to the invention and a base platform, one end of the base platform being laid on the space of the first base unit, the other end of the base platform being laid on the space of the second base unit.

According to particular embodiments, the flooring system section may comprise one, or a combination, of any of the following characteristics:

- the base platform comprises fastening means to fasten said base platform to the first and second base unit,
- the flooring system section further comprises supporting means provided under the base platform and engaging in normal use the floor to cover,
- the supporting means are provided along the length, and in the middle portion, of the base platform,
- the supporting means comprise pads having a truncated cone cross section and made of a resilient material,
- the base platform is made of wood.

The present invention relates also to a flooring system comprising at least one section piece according to the invention and an upper surface laid over the section piece.

According to particular embodiments, the flooring system may comprise one, or a combination, of any of the following characteristics:

- the upper surface is a one piece of wood.
- the upper surface comprises a plurality of interconnected panels arranged to form an angle of around 45 degree with the platforms of the section piece.

SHORT DESCRIPTION OF THE DRAWINGS

DETAILED DESCRIPTION OF THE INVENTION

Figure 1:
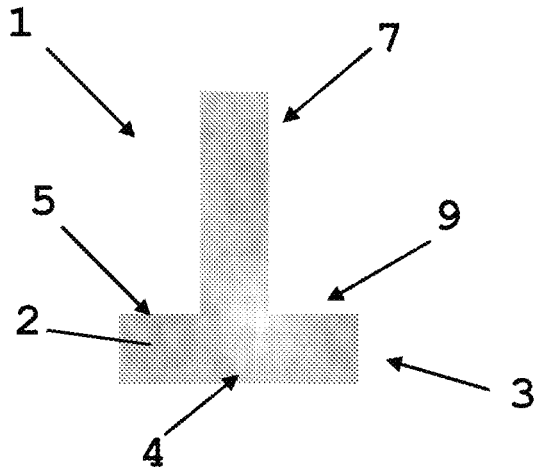
FIG. 1 represents schematically a cross-section view of a first embodiment of the base unit according to the invention.

The base unit 1 according to the invention is a sleeper for a flooring system. It is intended to support a base platform and an upper flooring to form a flooring system.

The base unit 1 comprises a body 2 made of a resilient material, more preferably made of rubber. Preferably, the body 2 has a density comprised between 30 pounds per cubic foot (480.55 Kg/m$^3$) and 70 pounds per cubic foot (1121.29 Kg/m$^3$).

The body 2 of the base unit 1 comprises a first portion 3, being a lower portion, comprising a first surface 4, which, in use, contact the floor to cover, and a second surface 5 opposite to the first surface 4. The body 2 further comprises a second portion 7, being an upper portion, provided above the first portion 3, on the second surface 5.

In a first preferred embodiment (FIG. 1), the base unit 1 has an inverted "T" shaped cross section wherein the second portion 7 is the stem portion of the inverted "T", and the first portion 3 the two branches extending outwardly from the stem portion.

Figure 2:
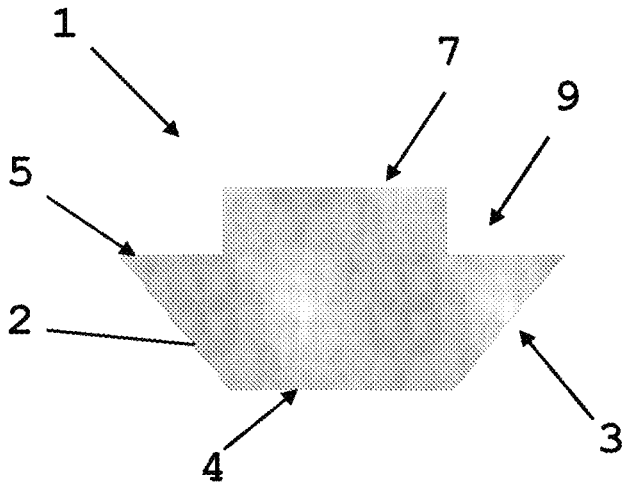
FIG. 2 represents schematically a cross-section view of a second embodiment of the base unit according to the invention.

In a second preferred embodiment (FIG. 2) the first portion 3 of the base unit 1 has a truncated cone cross section.

In another preferred embodiments (FIGS. 3 and 4), the first portion 3 has a truncated cone cross section on its lower part and a rectangular cross section 6 on its upper part.

In all the embodiments, the second portion 7 of the base unit 1 has preferably either a scare or a rectangular cross section.

Figure 3:
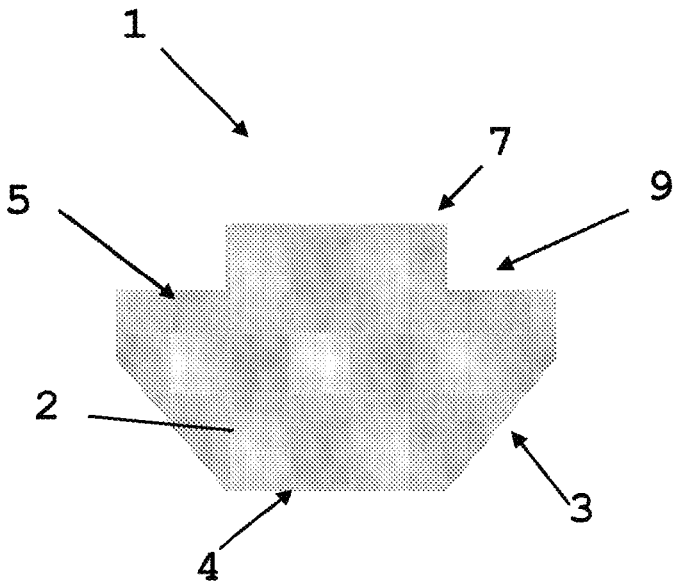
FIG. 3 represents schematically a cross-section view of a third embodiment of the base unit according to the invention.

In the embodiment represented in FIG. 3, the second portion 7 is provided substantially in the middle of the second surface 5 of the first portion 3 defining thus two spaces 9 running along each side of the second portion 7.

Figure 4:
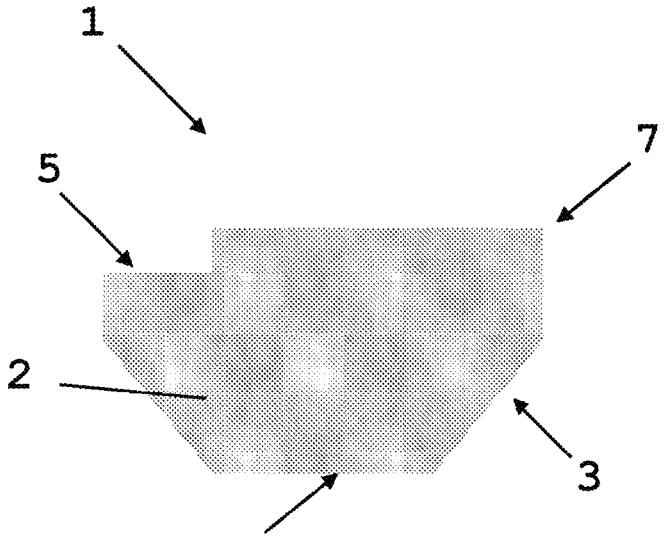
FIG. 4 represents schematically a cross-section view of a fourth embodiment of the base unit according to the invention.
Figure 5:
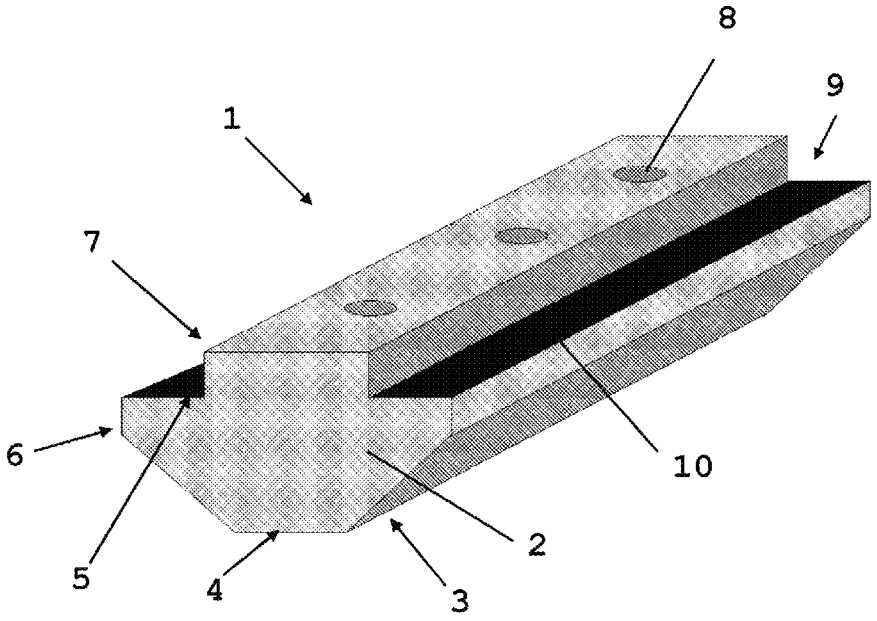
FIG. 5 represents schematically a perspective view of the third embodiment of the base unit according to the invention.

In the embodiment represented in FIG. 4, the second portion 7 is provided at the edge of the first portion 3 of the base unit 1, or has a width, so that only one space 9 is provided on the second surface 5. The base unit 1 comprised thus only one space 9 running along only one side of the second portion 7. This unit base 1 embodiment is particularly suitable at the edges of the flooring system, for example near walls.

The present invention will be now further described in respect to the embodiment of the base unit 1 presented in FIG. 3 for clarity reasons; however, this description applies also for any of the embodiments of the base unit 1.

Figure 6:
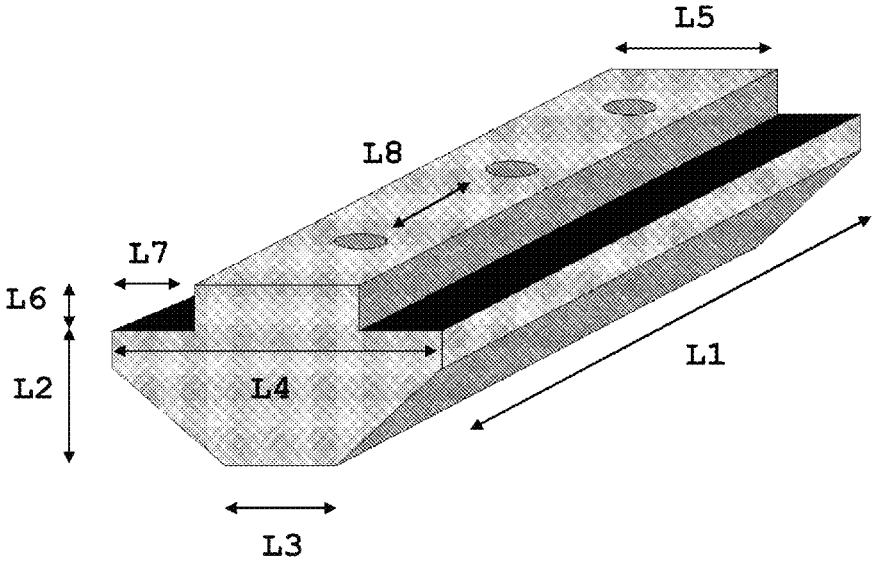
FIG. 6 represents schematically a perspective view of the third embodiment of the base unit according to the invention.

The first portion 3 of the base unit 1 has any suitable height, length and width (FIG. 6).

In a preferred embodiment, the first portion 3 is 4 feet (1.219 m) to 8 feet (2.438 m) long (L1), 2 inches (5.08 cm) to 4 inches (10.16 cm) wide (L4)—L3 being comprised between 1 inch (2.54 cm) to 1.5 inches (3.81 cm)—and ¾ inch (1.905 cm) to 1 inch (2.54 cm) high (L2).

The second portion 7 has any suitable height, length and width.

Preferably, its length is substantially equivalent or equal to the Length L1 of the base unit 1. Its width L5 is lower than the width L4 of the second surface 5 of the first portion 3. This allows creating on the second surface 5 at least one free space 9 defined by the side edge of the second portion 7 and the second surface 5 of the first portion 3.

In a preferred embodiment, the second portion 7 is around 8 feet (2.438 m) long (L1), 1 inch (2.54 cm) to 1.5 inches (3.81 cm) wide (L5) and around ½ inch (1.27 cm) high. The space 9 has preferably a width L7 of around ¾ inch (1.905 cm). In the embodiments wherein the base unit 1 comprises two spaces 9, said spaces 9 have preferably a width substantially equivalent or equal to each other.

Preferably, the overall height of the base unit 1 (L2 plus L6) is comprised between 1.25 inches (3.175 cm) and 1.5 inches (3.81 cm).

The second portion 7 may be provided along the entire length L1 of the first portion 3 or may be provided as a plurality of pieces having a substantially uniform cross-sectional geometry along the length of the first portion 3.

The base unit 1 further comprises anchoring means to anchor the base unit 1 to the surface to cover.

In a preferred embodiment, the anchoring means comprise one hole 8, more preferably a plurality of holes 8, extending from the upper surface of the second portion 7 to the first surface 4 of the first portion 3, through the entire height (L2 plus L6) of the base unit 1.

Preferably, the plurality of holes 8 are separated by a distance L8 comprised between 30 (76.2 cm) inches and 32 inches (81.28 cm).

The holes 8 cooperate with any suitable means, for example anchor pins, which are inserted into the holes 8 from the top of the second portion 7, to fix the base unit 1 to the surface to cover.

The base unit 1 may further comprise fastening means 10 to fasten a base platform 12. The fastening means 10 are provided on space 9, either continuously or discontinuously, preferably along the entire length of the base unit 1. It may be any suitable means, adhesives or fasteners, such as for example a glue, a thermal adhesive, a hook and loop fastener such as Velcro® type system or a combination thereof.

Figure 7:
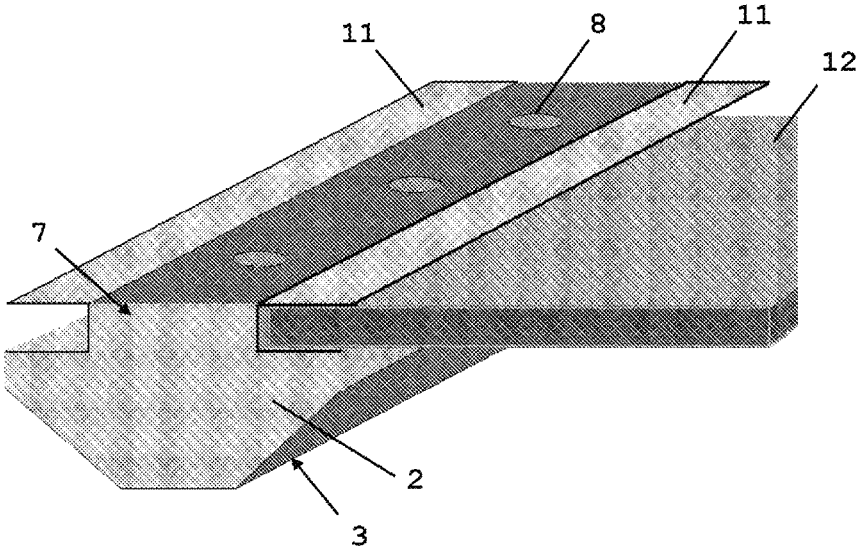
FIG. 7 represents schematically a perspective view of the base unit according to the invention comprising an embodiment of the fastening means to fasten a base platform.

In a preferred embodiment, the base unit 1 comprises at least one, preferably two, channel 11, preferably made of steel, and having a "U" shape. The channel 11 is provided on space 9, either continuously or discontinuously, along the second portion 7 of the base unit 1. Preferably, the opening of the channel 11 extends outwardly and perpendicularly from the edge of the second portion 7 of the base unit 1 (FIG. 7).

The base platform 12 is made of any suitable material, but preferably made of wood, more preferably made of plywood or OSB (oriented strand board). It may preferably have a length corresponding to the length L1 of the base unit 1 and a width (L9) of between 22 inches (55.88 cm) to 24 inches (60.96 cm). It has any suitable thickness so that a flat surface is provided between the upper surface of the second portion 7 and the upper surface of the base platform 12. Therefore, the thickness of the base platform 12 corresponds to the height L6 of the second portion 7 of the base unit 1. However, for the embodiments wherein the means cooperating with the anchoring means are anchor pins, for which once being in place the heads rise above the second portion 7, the thickness of the base platform 12 should corresponds to the height L6 plus the height of the portion anchor pins head rising above the second portion 7.

Figure 8:
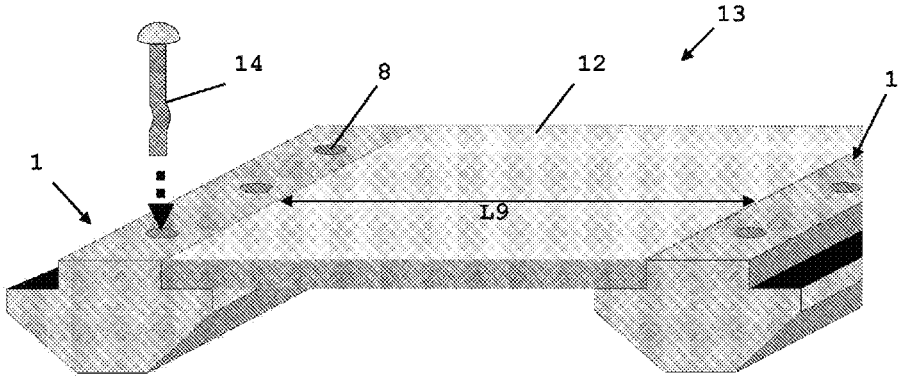
FIG. 8 represents schematically a perspective view of a first embodiment of a section piece of the flooring system according to the invention.

A portion of the base platform 12 is laid on the space 9 of the base unit 1 so that the base platform 12 is raised off the surface to cover (FIG. 8).

In the embodiments wherein fastening means 10 are not provided on space 9 of the base unit 1, the base platform 12 may comprise fastening means at least at the portions intended to contact the space 9. These means could be any suitable means such as for example a glue or a thermal adhesive. In the embodiment wherein the fastening means 10 are cooperative fasteners means, the base platform 12 may comprise the corresponding means cooperating with said fastening means 10. For example, the base platform 12 may comprise the hooks or the loops of the Velcro® type fastener cooperating with the loops or the hooks of the fastening means 10.

Two base units 1 and a base platform 12 form a section piece 13.

The section piece 13 may further comprises supporting means provided under, and supporting, the base platform 12. These supporting means may be shock absorption means (FIG. 9).

The supporting means may be any suitable means. Preferably, they comprise at least one device, more preferably a plurality of devices, made of any suitable resilient material and having any suitable profile.

Figure 9:
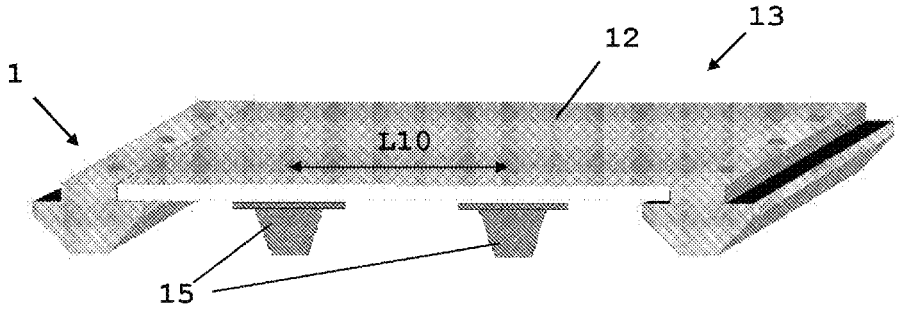
FIG. 9 represents schematically a perspective view of a second embodiment of a section piece of the flooring system according to the invention.

In a first preferred embodiment, the supporting absorption means comprise at least one pad 15, or a plurality of pads 15 periodically spaced and having substantially a uniform cross-sectional geometry (FIG. 9). Preferably, said pads present a square cross section, or more preferably a truncated cone cross section. They have any suitable height to engage the surface to cover in normal use.

The pads have any suitable hardness, preferably comprised between 30 and 70 durometer, more preferably between 30 and 35 durometer.

Preferably, the supporting means are provided under, along the length, and in the middle portion, of the base platform 12. They are fastened under the base platform 12 by any suitable means, either before or after the assembly of the section piece 13.

The flooring system according to the invention comprise at least two, more preferably a plurality of base unit 1, all base unit 1 being the same, or having different shapes and/and features according to the invention.

Preferably, the flooring system comprises at least one base unit 1 having two spaces 9, or at least one base unit 1 having one space 9.

The flooring system comprises at least one section piece 13, more preferably a plurality of section pieces 13, and an upper surface 14.

Figure 10:
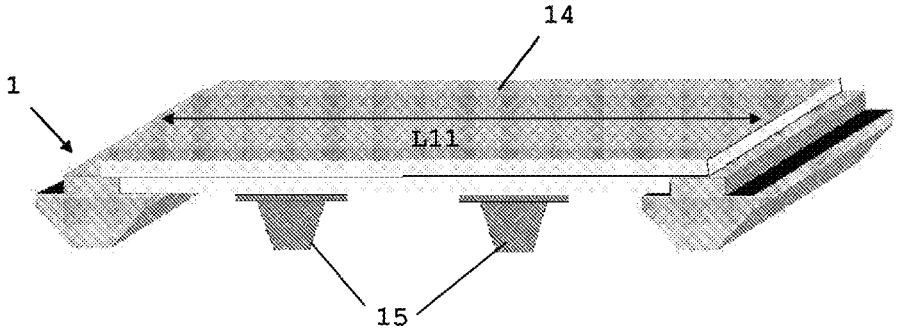
FIG. 10 represents schematically a perspective view of the second embodiment of the section piece with an upper flooring to form a flooring system according to the invention.

The flooring system may comprise section pieces 13 comprising one or a plurality of supporting means, for example one or a plurality of pads The upper surface 14 is laid on the top of, and covering, the base platform 12 and all, or a portion, of the base units 1 forming a section piece 13 (FIG. 10).

The upper surface 14 is made of any suitable material, preferably a playing surface and more preferably made of wood.

It one preferred embodiment, the upper surface 14 is a one piece of material. In another preferred embodiment, the upper surface 14 is made of several interconnected panels.

The upper surface 14 has a length corresponding to the length L1 of the base units. Preferably, its width L11 is higher then the width L9 of the base platform 12 so that the upper surface 14 covers a portion of the second portion 7 of the base unit 1. This allows adjacent upper surfaces 14 sharing a common base unit 1 to be seamlessly arranged. Preferably, the width L11 is comprised between 2 feet and 4 feet (0.6096 m to 1.219 m).

For example, the interconnected panels forming the upper surface 14 may be Plywood panels of 8 feet (2.438 m) long, 4 feet (1.219 m) wide and 15/32 inch (1.191 cm) high or ½ inch (1.27 cm) high.

Figure 11:
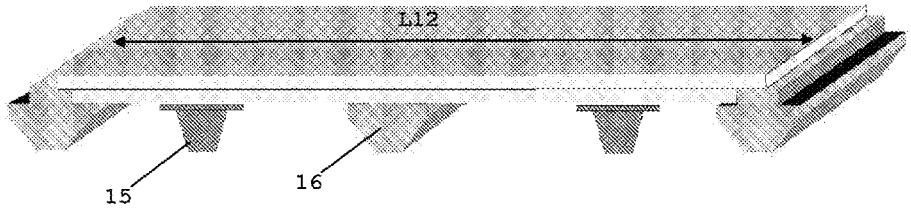
FIG. 11 represents schematically a perspective view of another embodiment of the flooring system according to the invention.

FIG. 11 represents an embodiment of the flooring system wherein the flooring system comprises two section pieces 13, comprising thus three base units 1, two base platforms 12 and one upper surface 14 which is twice as wide as the base platforms 12. The upper surface 14 may be four feet wide for example. The flooring system may further comprise at least one pad per section pieces 13 as supporting means between each base unit 1.

Figure 12:
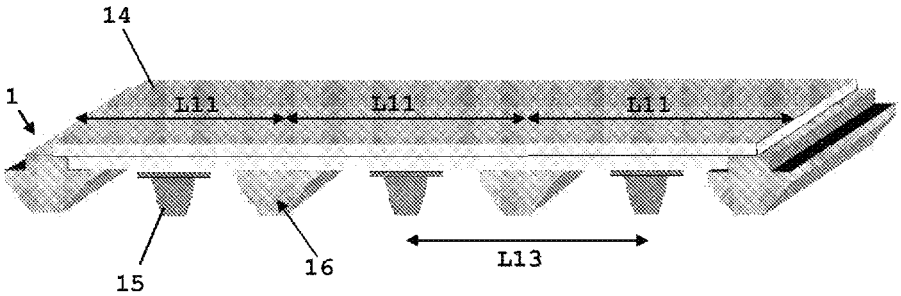
FIG. 12 represents schematically a perspective view of another embodiment of the flooring system according to the invention.

FIG. 12 represents an embodiment of the flooring system wherein the flooring system comprises three section pieces 13, comprising thus four base units 1, three base platforms 12 and one upper surface which is three times as wide as the supporting platforms 12. The flooring system may further comprise at least one pad per section pieces 13 as supporting means between each base unit 1.

Preferably, the base units 1 are separated one from the others by the distance L11 and the supporting means are separated one from the others by a distance L13 equivalent to L12.

In the embodiments represented in FIGS. 11 and 12, the central base unit 1, or all base units 1, may be pre-attached to the base platforms 12 before the upper surface 14 is laid on the section piece 13.

Figure 13:
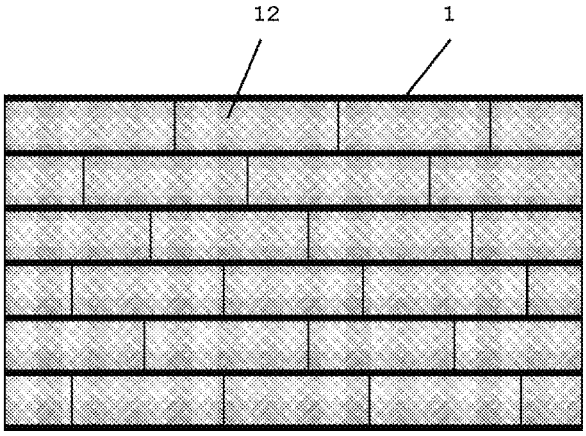
FIG. 13 represents schematically an upper view of an assembly of several section pieces according to the invention.
Figure 14:
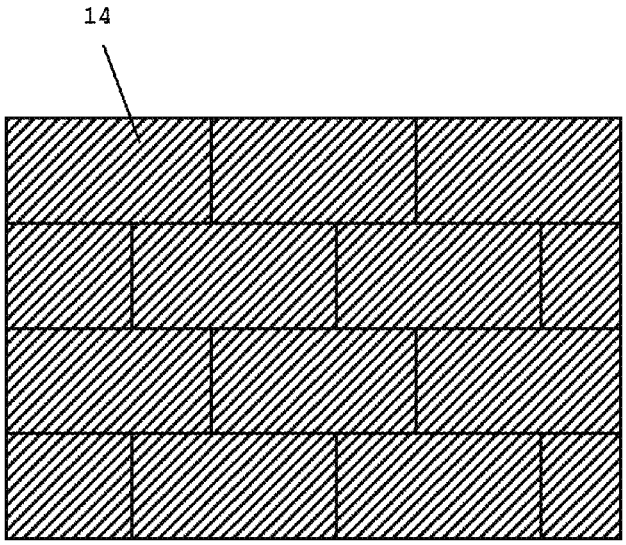
FIG. 14 represents schematically an upper view of an embodiment of the flooring system according to the invention.
Figure 15:
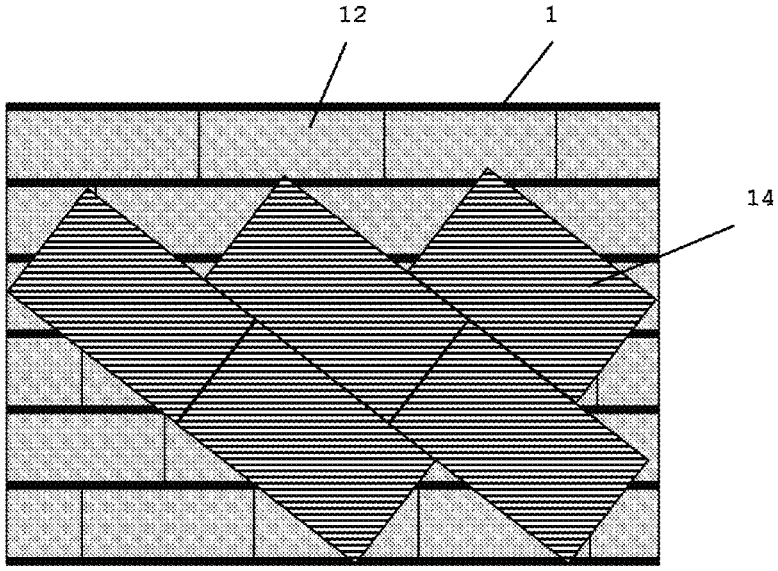
FIG. 15 represents schematically an upper view of another embodiment of the flooring system according to the invention.

For the embodiments of the flooring system wherein the upper surface 14 is made of several interconnected panels, said panels are provided, either anchored or floating, provided over the plurality of section pieces 13 (FIG. 13) substantially parallel to the platforms 12 (FIG. 14), or forming an angle of around 45 degree with the platforms 12 (FIG. 15).

Preferably, the interconnected panels are connected one to the other with a gap between the panels of between ¼ inch (6.35 mm) to ⅜ inch (9.525 mm).

The invention claimed is:

1. A flooring system base unit made of a resilient material and comprising:

a first portion having a first surface which, in use, contacts the floor to cover, and a second surface, opposite to said first surface, a second portion set above said first portion, at least one space provided on said second surface of said first portion and laterally delimited by a side edge of said second portion, anchoring means provided through said first and second portions to anchor said base unit to the floor to cover; and a fastening means provided on the at least one space to fasten a base platform, said fastening means including a channel, having "U" shape, and extending outwardly and perpendicularly from the edge of said second portion of the base unit.

2. The base unit according to claim 1, comprising: a first and a second space provided on said second surface of said first portion, said first space being laterally delimited by a first side edge of said second portion, and said second space being laterally delimited by a second side edge of said second portion.

3. The base unit according to claim 1, wherein said second portion is provided along the entire length of said first portion.

4. The base unit according to claim 1, wherein the anchoring means comprising at least one hole extending from the upper surface of the second portion to the first surface of the first portion, through the entire height of the base unit.

5. The base unit according to claim 1, wherein said first portion has a truncated cone cross section and said second portion has a rectangular cross section.

6. A flooring system section piece comprising:

at least a first and a second base unit, each of said first and a second base unit being made of a resilient material and comprising:

a first portion having a first surface which, in use, contacts the floor to cover, and a second surface, opposite to said first surface;

a second portion set above said first portion;

at least one space provided on said second surface of said first portion and laterally delimited by a side edge of said second portion;

anchoring means provided through said first and second portions to anchor said base unit to the floor to cover; and said flooring system section piece further comprising a base platform, one end of said base platform being laid on the at least one space of said first base unit, the other end of said base platform being laid on the at least one space of said second base unit.

7. The flooring system section piece according to claim 6, wherein the base platform comprises fastening means to fasten said base platform to the first and second base unit.

8. The flooring system section piece according to claim 6, further comprising supporting means provided under the base platform and engaging in normal use the floor to cover.

9. The flooring system section piece according to claim 8, wherein the supporting means are provided along the length, and in the middle portion, of the base platform.

10. The flooring system section piece according to claim 8, wherein the supporting means comprise pads having a truncated cone cross section and made of a resilient material.

11. The flooring system section piece according to claim 6, wherein the base platform is made of wood.

12. A flooring system comprising at least one section piece according to claim 6, and an upper surface laid over said section piece.

13. The flooring system according to claim 12, wherein the upper surface is a one piece of wood.

14. The flooring system according to claim 12, wherein the upper surface comprises a plurality of interconnected panels arranged to form an angle of about 45 degrees with the platforms of the section piece.

15. The flooring system section piece according to claim 6, wherein at least one of said first and second base unit comprises a first and a second space provided on said second surface of said first portion, said first space being laterally delimited by a first side edge of said second portion, and said second space being laterally delimited by a second side edge of said second portion.

16. The flooring system section piece according to claim 6, wherein the anchoring means of at least one of said first and second base unit comprises at least one hole extending from an upper surface of said second portion to said first surface of said first portion, through the entire height of the respective base unit.

17. The base unit according to claim 6, wherein at least one of said first and second base unit comprises fastening means provided on the at least one space to fasten the base platform.

18. The flooring system section piece according to claim 17, wherein said fastening means includes a channel having a "U" shape, wherein its opening extends outwardly and perpendicularly from the side edge of said second portion of the base unit, the end of the base platform laid on the space of the base unit being received in said channel.

19. The base unit according to claim 6, wherein in at least one of said first and second base unit, said first portion has a truncated cone cross section and said second portion has a rectangular cross section.

* * * * *